US008123635B2

(12) United States Patent
Gillis

(10) Patent No.: US 8,123,635 B2
(45) Date of Patent: Feb. 28, 2012

(54) ARM EXTENSION APPARATUS

(76) Inventor: Gregory F. Gillis, Waunakee, WI (US)

( * ) Notice: Subject to any disclaimer, the term of this patent is extended or adjusted under 35 U.S.C. 154(b) by 18 days.

(21) Appl. No.: 12/699,194

(22) Filed: Feb. 3, 2010

(65) Prior Publication Data

US 2011/0190080 A1 Aug. 4, 2011

(51) Int. Cl.
*A63B 69/00* (2006.01)

(52) U.S. Cl. ..... 473/450; 473/422; 440/101; 441/56

(58) Field of Classification Search ..... 473/450, 473/463, 447, 422; D12/215; 440/101; 33/262; 294/1.1; 416/63; 441/56
See application file for complete search history.

(56) References Cited

U.S. PATENT DOCUMENTS 3,518,024 A * 6/1970 Wilson ..... 416/63
3,712,618 A * 1/1973 Berzatzy ..... 473/538
5,062,816 A * 11/1991 Berglund et al. ..... 440/101
6,082,795 A * 7/2000 Fornelli ..... 294/58
6,085,765 A * 7/2000 Sigsworth ..... 135/68
6,398,603 B1 * 6/2002 Brown ..... 441/56
6,464,272 B1 * 10/2002 Michaud ..... 294/58
6,598,266 B1 * 7/2003 Elliott ..... 16/430
7,361,070 B2 * 4/2008 Bolstor ..... 441/56
2003/0130074 A1 7/2003 Petroskey
2006/0199676 A1 * 9/2006 Ashbaugh ..... 473/448
2006/0199679 A1 9/2006 Hardy
2009/0242007 A1 * 10/2009 Heyer et al. ..... 135/71

* cited by examiner

*Primary Examiner* — Gene Kim
*Assistant Examiner* — M Chambers
(74) *Attorney, Agent, or Firm* — Dale J. Ream

(57) ABSTRACT

An arm extension apparatus includes a base having an elongate configuration. The apparatus includes a paddle coupled to the base and having proximal and distal portions, the paddle being slidably movable relative to the base between a retracted configuration in which the proximal portion is substantially received adjacent the base and an extended configuration in which the proximal portion is substantially extended from the base. An attachment member is coupled to the base and having a configuration complementary to the person's arm, the attachment member having a strap extending therefrom for removably securing the attachment member to the person's arm.

5 Claims, 5 Drawing Sheets

Locked

Unlocked

ARM EXTENSION APPARATUS

BACKGROUND OF THE INVENTION

This invention relates generally to sports training aids and, more particularly, to an arm extension apparatus that attaches to an arm of a user and is adjustable to simulate a player with a larger than normal arm span.

In many competitive sports, it is advantageous to train or scrimmage against opponents of various sizes and often against opponents of larger sizes. For example, basketball players often desire to train to play against players that are taller than themselves. Similarly, volleyball players may wish to train to play against opponents who are taller and more capable of blocking their hits. In football, training against taller or quicker players enables a quarterback to learn to pass the ball more quickly or evade pursuit. A receiver may use similar training to make catches against taller players. A soccer player may also desire training against larger or faster players to enhance his ability to score against a taller or quicker goal keeper. Training to play against taller players may help to prepare to play such players or to make them even more capable of playing against smaller or same-size players.

Various devices have been proposed in the art for assisting competitive sports players prepare to play a game. Although assumably effective for their intended purposes, the existing devices and proposals do not enable a defensive player to simulate longer arms in a manner that provides realistic yet safe training to an offensive counterpart and still enables the defensive trainer to maintain complete use of his own hands.

Therefore, it would be desirable to have an arm extension apparatus that enables a person to simulate having longer arms and, as a result, to train another player to play against a player who is taller or has longer arms than himself. Further, it would be desirable to have an arm extension apparatus that provides simulated arms that are rigid but do not injure another player in use. In addition, it would be desirable to have an arm extension apparatus that enables the defensive player wearing the apparatus to use his own hands without interruption.

SUMMARY OF THE INVENTION

An arm extension apparatus according to the present invention includes a base having an elongate configuration. The apparatus includes a paddle coupled to the base and having proximal and distal portions, the paddle being slidably movable relative to the base between a retracted configuration in which the proximal portion is substantially received adjacent or within the base and an extended configuration in which the proximal portion is substantially extended from the base. An attachment member is coupled to the base having a configuration complementary to the person's arm, the attachment member having a strap extending therefrom for removably securing the attachment member to the person's arm.

Therefore, a general object of this invention is to provide an arm extension apparatus for wear by a sports player or coach that simulates a player having longer arms, increased height, or greater quickness.

Another object of this invention is to provide an arm extension apparatus, as aforesaid, that enables a user to use his hands without interruption.

Still another object of this invention is to provide an arm extension apparatus, as aforesaid, that is rigid to withstand impact by other players or a ball yet without injuring another player.

Yet another object of this invention is to provide an arm extension apparatus, as aforesaid, that is length adjustable to simulate players of selected sizes.

A further object of this invention is to provide an arm extension apparatus, as aforesaid, that is easy and comfortable to attach to a user.

A still further object of this invention is to provide an arm extension apparatus, as aforesaid, that is cost-effective to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

An arm extension apparatus according to embodiments of the present invention will now be described in detail with reference to FIGS. 1 to 5*c* of the accompanying drawings. The arm extension apparatus 10 generally includes a base 12, a paddle 20, and an attachment member 30.

Figure 1:
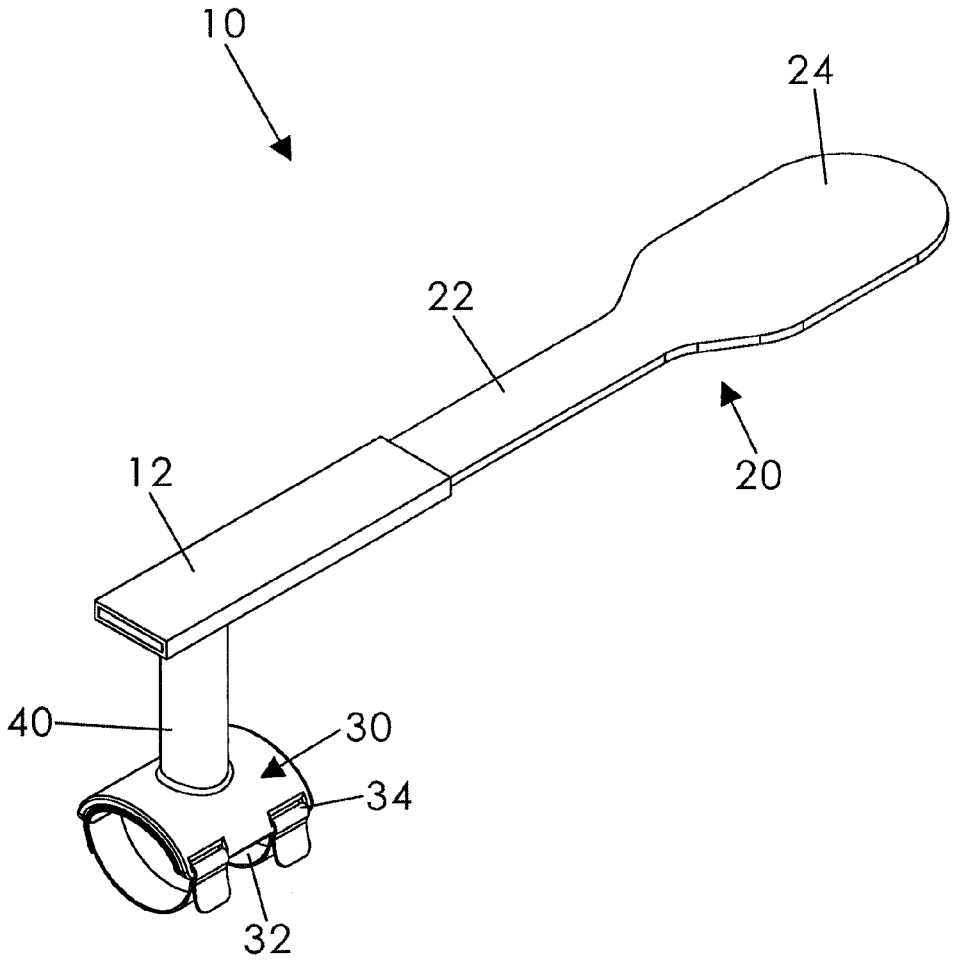
FIG. 1 is a top perspective view of an arm extension apparatus according to a preferred embodiment of the present invention.
Figure 2:
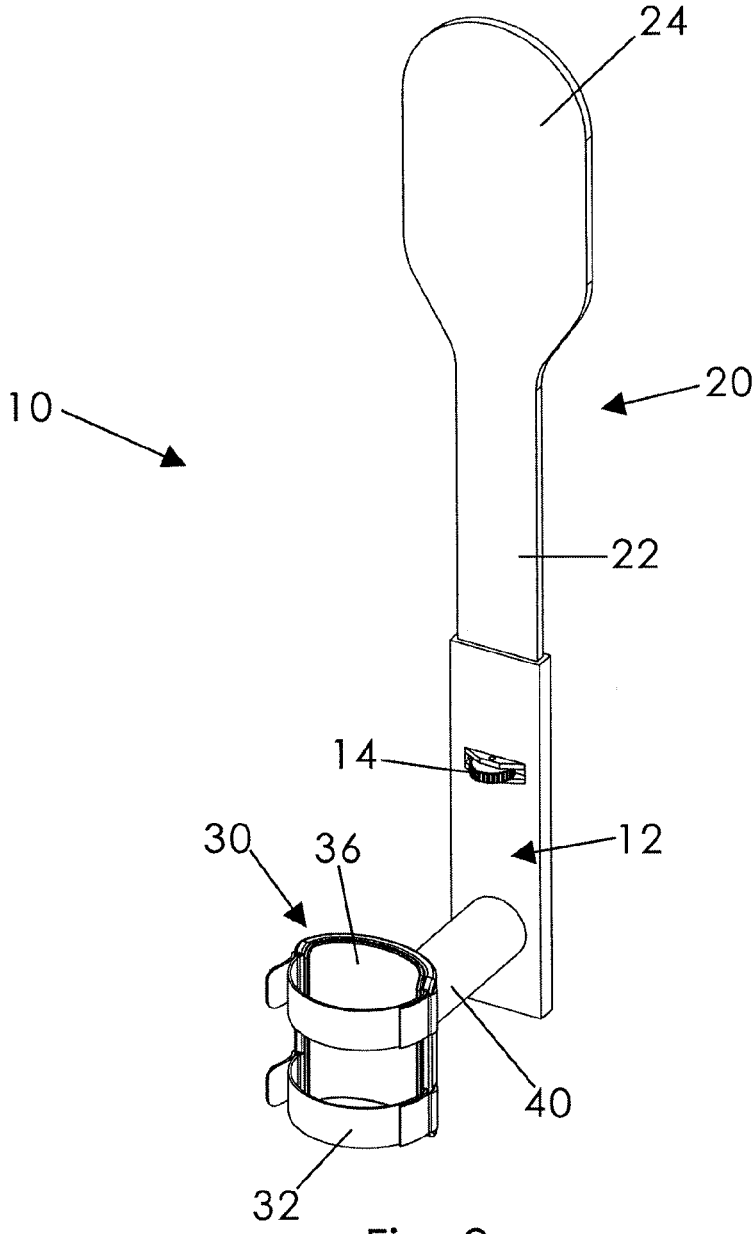
FIG. 2 is a bottom perspective view of the arm extension apparatus as in FIG. 1.
Figure 3:
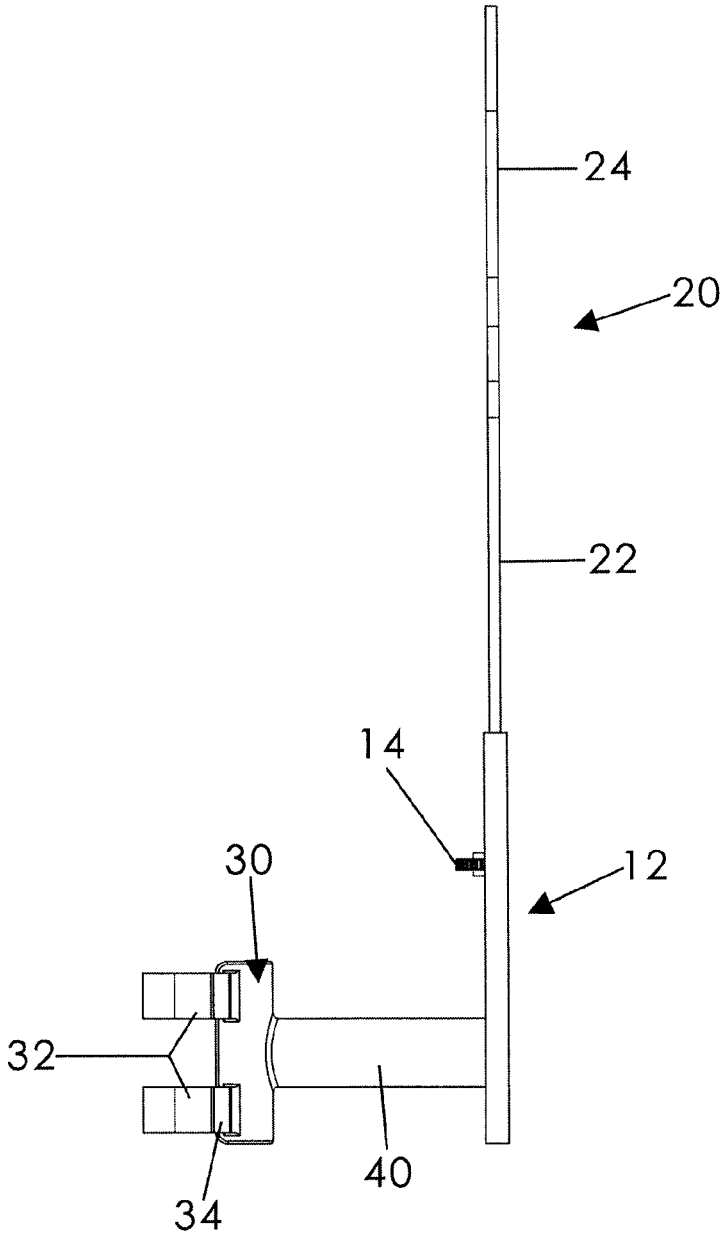
FIG. 3 is a side view of the arm extension apparatus as in FIG. 2.
Figure 4:
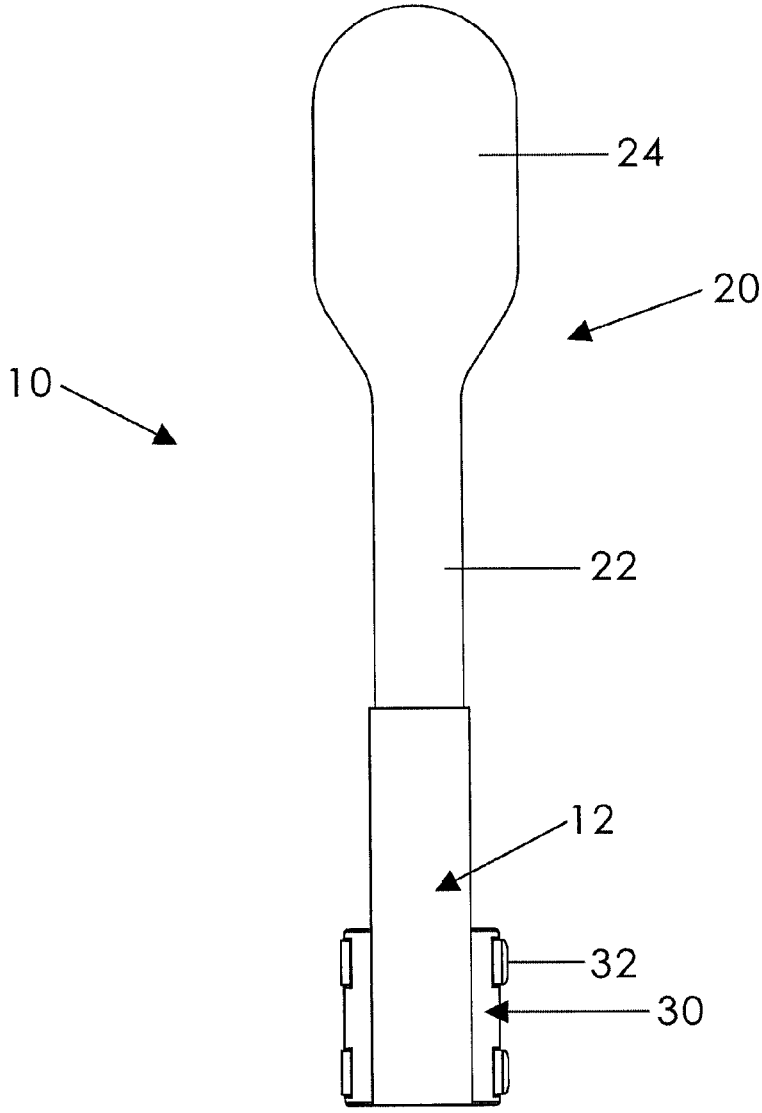
FIG. 4 is a top view of the arm extension apparatus as in FIG. 1.
Figure 5A:
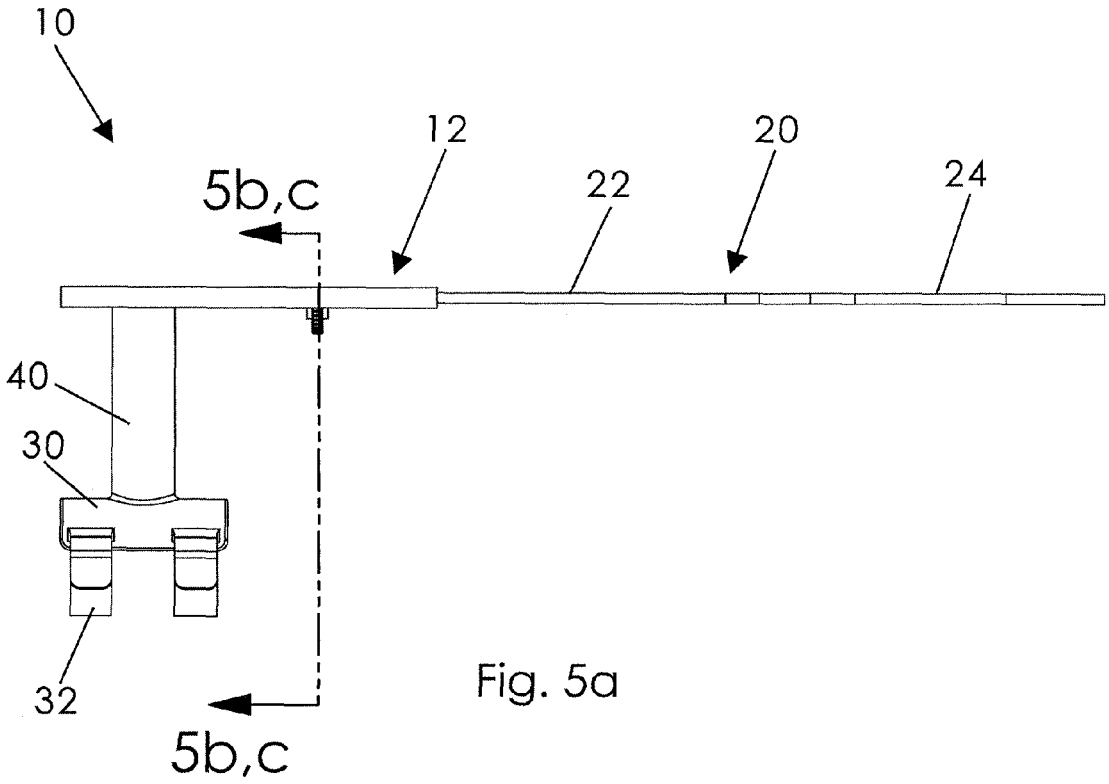
FIG. 5*a* is a side view of the arm extension apparatus as in FIG. 1.
Figure 5C:
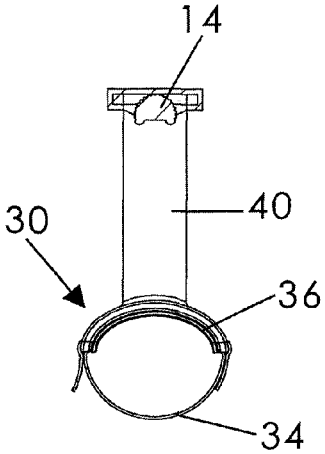
FIG. 5*c* is a sectional view taken along line 5*b, c*-5*b, c* of FIG. 5*a* in a locked configuration.
Figure 5B:
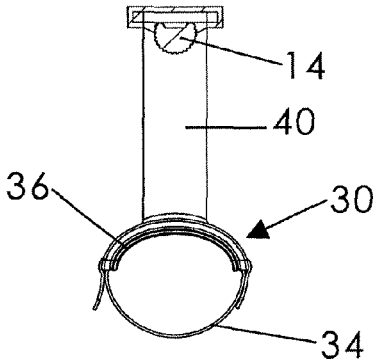
FIG. 5*b* is a sectional view taken along line 5*b, c*-5*b, c* of FIG. 5*a* in an unlocked configuration.

The base 12 includes a generally flat elongate configuration that may define an interior space (FIG. 1). More particularly, the base 12 may present a thin rectangular box-like shape having an open interior and defining at least an open end although a base 12 having another configuration may also be suitable. It is understood that alternative constructions are also possible such as an elastic or cloth sleeve removably securable on a user's forearm.

Further, the paddle 20 includes proximal 22 and distal 24 portions. The proximal portion 22 includes a generally elongate planar configuration that is complementary to the open end of the base 12 and to the interior space such that the proximal portion 22 is slidably receivable therein. More particularly, the paddle 20 is slidably movable relative to the base 12 between a retracted configuration in which the proximal portion 22 is substantially received in the interior space defined by the base 12 and an extended configuration in which the proximal portion 22 extends outwardly from the open end of the base 12 (FIG. 1). In other words, the proximal portion 22 is positioned substantially inside the interior space at the retracted configuration and substantially outside the interior space at the extended configuration. It is understood that the base 12 may alternatively not define a substantially enclosed interior space as described above, but rather may just include a planar panel and that the paddle 20 is slidably coupled thereto. In this instance, the proximal portion 22 would be substantially adjacent the planar panel of the base 12 at the retracted configuration and would extend substantially away from the planar panel at the extended configuration. As shown in FIG. 1, the base 12 and the paddle 20 define an imaginary longitudinal axis.

The distal portion 24 of the paddle 20 may include a configuration that is generally planar but that has a width larger than a width of the proximal portion 22. There may be a tapered section connecting the proximal and distal portions together. The distal portion 24, therefore, includes a surface area that is greater than a surface area of the proximal portion 22 and is conducive to the intended purpose of simulating a defender. It is understood that the paddle 20 includes a rigid frame surrounded by a layer of padding such that the paddle 20 holds its form even when impacted while not causing injury.

The attachment member 30 is, at one aspect, coupled to the base 12 and, at another aspect, removably attachable to the arm of a person such the arm extension apparatus 10 is useful in athletic training. More particularly, the attachment member 30 has a generally arcuate configuration complementary to the curvature of a person's forearm so as to nest snugly thereon. The attachment member 30 may include a layer of closed cell rubber padding 36 on its bottom side although other suitable types of padding may also be used. The attachment member 30 also includes one or more straps 32 extending outwardly therefrom and adapted to extend about a user's arm. Preferably, the straps 32 may include one or more fasteners 34 taken from the group including hook and loop fasteners, buckles, snaps, clasps, or the like so as to securely attach the straps about a user's arms.

A connection member 40 connects the base 12 to the attachment member 30. The connection member 40 causes the base 12 and paddle 20 to be offset from the attachment member 30 which enables the user to have greater freedom to use his hands without interruption. Preferably, the connection member 40 is situated generally perpendicular to the base 12 and attachment member 30 such that the base 12 and paddle 20 are generally parallel to the user's arm.

Further, the arm extension apparatus 10 includes a stop 14 movably coupled to the base 12 between an open configuration allowing said paddle proximal portion 22 to slidably move relative to the base 12 and a closed configuration not allowing the paddle proximal portion 22 to move relative to the base 12. In other words, the paddle 20 may be moved between retracted and extended configurations when the stop 14 is in the open configuration and then locked into place by moving the stop 14 to the closed (locked) configuration.

In use, a person may strap an arm extension apparatus 10 to his forearm as described above for use in athletic training, such as basketball, volleyball, football, or soccer training. In fact, an arm extension apparatus 10 may be attached to each arm so as to simulate a player with longer arms, greater height, or greater quickness. Either before or after being attached to a user's arms, the paddle 20 may be moved to a desired extended configuration when the stop 14 is at the open configuration. Once the paddle 20 is adjusted to a desired length, the stop 14 may be moved to its closed configuration so as to "lock" the paddle in position. With the paddle extended, the user may play defense in a generally traditional fashion and, as a result, simulate a taller player, one with longer arms, or greater quickness.

Accordingly, the arm extension apparatus 10 enables a player to practice against another player who simulates a larger or quicker player as a result of wearing one or two arm extension apparatus.

It is understood that while certain forms of this invention have been illustrated and described, it is not limited thereto except insofar as such limitations are included in the following claims and allowable functional equivalents thereof.

The invention claimed is:

1. An arm extension apparatus for use by a person for athletic training, comprising:

a base having an elongate generally planar configuration and defining an interior space and an open end in communication with said interior space;

a paddle coupled to said base and having proximal and distal portions, said paddle being slidably movable relative to said base between a retracted configuration in which said proximal portion of said paddle is substantially received inside said interior space of said base through said open end and an extended configuration in which said proximal portion is substantially outside said interior space of said base;

an attachment member coupled to said base and having a generally arcuate configuration complementary to the person's forearm, said attachment member having a strap extending therefrom for removably securing said attachment member to the person's arm such that said attachment member is removably positioned thereon and said strap is removably extended thereabout;

wherein:

said paddle proximal portion includes a generally planar and elongate configuration complementary to a configuration of said base and said paddle distal portion includes a generally planar configuration having a width greater than a width of said paddle proximal portion;

said paddle includes a tapered section connecting said proximal and distal portions together;

said base and said paddle define a single imaginary longitudinal axis and are co-planar; and said base having a stop coupled to said base and movable between an open configuration allowing said paddle to slidably move relative to said base and a closed configuration not allowing said paddle to move relative to said base; and a connection member extending between said base and said attachment member, said connection member having a generally rigid construction causing said base and said paddle to be offset a fixed distance from said attachment member and generally perpendicular to said base and to said attachment member such that said paddle is operable without use of a user's hands.

2. The arm extension apparatus as in claim 1, wherein said stop extends from a bottom side of said base and is generally perpendicular relative to said paddle, said stop extending outwardly from said bottom side of said base at said open configuration and being inserted into said base at said locked configuration.

3. The arm extension apparatus as in claim 1, further comprising padding attached to a bottom side of said arm extension member for contact with the person's arm, said padding being closed cell rubber.

4. The arm extension apparatus as in claim 1, wherein said paddle includes a rigid inner frame and a layer of padding surrounding said rigid inner frame, said layer of padding including closed cell rubber.

5. The arm extension apparatus as in claim 1, wherein said strap of said attachment member includes a fastener taken from the group consisting of a hook and loop fastener, a buckle, a snap, and a clasp.

* * * * *